US011149759B2

(12) United States Patent
Young et al.

(10) Patent No.: US 11,149,759 B2
(45) Date of Patent: Oct. 19, 2021

(54) HYDRAULIC BYPASS CIRCUIT

(71) Applicant: Clark Equipment Company, West Fargo, ND (US)

(72) Inventors: Charles Young, Bismarck, ND (US); Jason R. Coombs, Bismarck, ND (US)

(73) Assignee: CLARK EQUIPMENT COMPANY, West Fargo, ND (US)

( * ) Notice: Subject to any disclaimer, the term of this patent is extended or adjusted under 35 U.S.C. 154(b) by 0 days.

(21) Appl. No.: 16/522,292

(22) Filed: Jul. 25, 2019

(65) Prior Publication Data

US 2020/0031644 A1 Jan. 30, 2020

Related U.S. Application Data

(60) Provisional application No. 62/703,215, filed on Jul. 25, 2018.

(51) Int. Cl.
*F15B 13/06* (2006.01)
*F15B 13/02* (2006.01)
(Continued)

(52) U.S. Cl.
CPC ..... *F15B 13/06* (2013.01); *E02F 3/651* (2013.01); *E02F 3/84* (2013.01); *E02F 9/2235* (2013.01);
(Continued)

(58) Field of Classification Search
CPC . F15B 11/0426; F15B 11/055; F15B 11/0423; F15B 2211/455; F15B 2211/351;
(Continued)

(56) References Cited

U.S. PATENT DOCUMENTS 4,949,805 A * 8/1990 Mather ..... E02F 9/2025 180/324
9,624,643 B2 * 4/2017 Hendron ..... E02F 3/847
(Continued)

FOREIGN PATENT DOCUMENTS

EP 3026243 A1 6/2016

OTHER PUBLICATIONS

International Search Report and Written Opinion dated Oct. 10, 2019 for International Application No. PCT/US2019/034353 filed Jul. 25, 2019, 12 pages.

*Primary Examiner* — Dustin T Nguyen
(74) *Attorney, Agent, or Firm* — John Veldhuis-Kroeze; Westman, Champlin & Koehler, P.A.

(57) ABSTRACT

Disclosed embodiments include hydraulic systems which provide power to lift, tilt and auxiliary (e.g., implement) functions, including high-flow auxiliary functions, with increased efficiency. Disclosed embodiments incorporate a single variable displacement pump that supplies pressurized fluid to a main control valve (e.g., for lift, tilt, and auxiliary functions) and a bypass circuit. The main control valve supplies fluid to control lift, tilt, and auxiliary flow for implements. The bypass circuit combines flow with the output of the auxiliary section of the main control valve to optionally provide high-flow for selected implements. The single variable displacement pump can then be set to different output flow levels, with the bypass circuit functioning differently under different conditions to optimize hydraulic flow to carryout various tasks under various conditions.

14 Claims, 6 Drawing Sheets

(51) Int. Cl.

| | |
|---|---|
| ***E02F 3/65*** | (2006.01) |
| ***E02F 3/84*** | (2006.01) |
| ***E02F 9/22*** | (2006.01) |
| *B66F 9/22* | (2006.01) |

(52) U.S. Cl.
CPC ..... *F15B 13/022* (2013.01); *B66F 9/22* (2013.01); *F15B 2211/30565* (2013.01); *F15B 2211/30585* (2013.01); *F15B 2211/45* (2013.01)

(58) Field of Classification Search
CPC .. F15B 2211/30565; F15B 2211/30585; F15B 2211/30595; F15B 2211/3059; F15B 2211/40553; F15B 2211/40592; F15B 13/022; F15B 13/06; F15B 2211/46; E02F 9/2282; E02F 9/2296
See application file for complete search history.

(56) References Cited

U.S. PATENT DOCUMENTS

| | | | | |
|---|---|---|---|---|
| 9,803,748 | B2 * | 10/2017 | Hendrix | F16H 61/4061 |
| 9,915,056 | B2 * | 3/2018 | Tanaka | E02F 9/2242 |
| 10,273,988 | B2 * | 4/2019 | Kondo | F15B 11/08 |
| 2013/0318958 | A1 | 12/2013 | Coombs et al. | |
| 2020/0271136 | A1 * | 8/2020 | Kristensen | F15B 13/042 |

* cited by examiner

HYDRAULIC BYPASS CIRCUIT

CROSS-REFERENCE TO RELATED APPLICATION

This application claims the benefit of U.S. Provisional Application No. 62/703,215, which was filed on Jul. 25, 2018.

BACKGROUND

This disclosure is directed toward power machines. More particularly, this disclosure is directed to hydraulic systems of power machines such as loaders, which provide different levels of hydraulic flow to implements attached to the power machines.

Power machines, for the purposes of this disclosure, include any type of machine that generates power for the purpose of accomplishing a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Typically, hydraulic functions on a loader (lift, tilt, auxiliary) are provided flow from a constant displacement gear pump. Some implements require higher flow of hydraulic oil or fluid than others. To provide a "high-flow" option, flow from a second gear pump can be selectively mated with flow from the first gear pump to provide additional flow for implements that can handle such flow. This high flow option allows a power machine to utilize more demanding implements. However, this method of providing high-flow can be inefficient.

The discussion above is merely provided for general background information and is not intended to be used as an aid in determining the scope of the claimed subject matter.

SUMMARY

Disclosed embodiments include hydraulic systems which provide power to lift, tilt, and auxiliary (e.g., implement) functions. The disclosed hydraulic and power systems provide power to auxiliary functions while both using more efficient hydraulic flow rates from a pump, and while also allowing high-flow implements to be used. Disclosed embodiments incorporate a single variable displacement pump that supplies pressurized fluid to a main control valve (e.g., for lift, tilt and auxiliary functions) and a bypass circuit. The main control valve supplies fluid to control lift, tilt, and auxiliary flow for implements. The bypass circuit meets up with the output of the auxiliary section of the main control valve to optionally provide "high-flow" for selected implements. The single variable displacement pump can then be set to different output flow levels, with the bypass circuit functioning differently under different conditions to optimize hydraulic flow to carryout various tasks under various conditions.

Disclosed embodiments include power machines, such as loaders, and hydraulic circuits configured to provide power to at least one implement actuator of an implement mounted on the power machine. Control of the circuit can implemented using one or more controllers or computers configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

One general aspect of disclosed embodiments include a circuit of a power machine (100; 200; 300) for providing power to at least one implement actuator (330) of an implement mounted on the power machine. The hydraulic circuit includes: an implement pump (224C; 310) configured to receive hydraulic fluid from a tank (302) through an input conduit (304) and to supply a flow of pressurized hydraulic fluid at an implement pump outlet conduit (312); a main control valve (320) coupled to the implement pump output conduit (312) and configured to provide pressurized hydraulic fluid from the implement pump to the at least one implement actuator (330) through a control valve output conduit (322); and a bypass circuit (340) having an inlet conduit (314) coupled to the implement pump outlet conduit (312) to selectively receive a portion of the flow of pressurized hydraulic fluid from the implement pump and to provide the portion of the flow of pressurized hydraulic fluid to the at least one implement actuator (330) at a bypass circuit output conduit (342) coupled to the control valve output conduit (322) such that flow of pressurize hydraulic fluid provided to the at least one implement actuator is a combined flow including flow through the main control valve and flow bypassing the main control valve.

Implementations may include one or more of the following features. The circuit and further including a controller (350) in communication with both main control valve and the bypass circuit to selectively control the main control valve and the bypass circuit to supply the combined flow of pressurized hydraulic fluid to the at least one implement actuator.

The circuit where the implement pump (224C; 310) is a variable displacement pump configured to provide a variable flow of pressurized hydraulic fluid at the implement pump outlet conduit (312) responsive to control signals from the controller (350). The circuit where the controller (350) controls each of the implement pump (224C; 310), the main control valve (320) and the bypass circuit (340) responsive to signals from a user input (360) indicating an increased flow requirement to the at least one implement actuator (330).

The circuit where the controller (350) is configured such that responsive to signals from the user input indicating a standard flow requirement of the at least one implement actuator (330), the controller controls the variable displacement pump (224C; 310) to provide a first flow rate of pressurized hydraulic fluid at the implement pump outlet conduit (312) and controls the bypass circuit (340) to block flow through the bypass circuit such that substantially all of the flow of pressurized hydraulic fluid provided at the first flow rate passes through the main control valve (320).

The circuit where the controller (350) is configured such that responsive to signals from the user input indicating a higher flow requirement of the at least one implement actuator (330), the controller controls the variable displacement pump (224C; 310) to provide a second flow rate of pressurized hydraulic fluid, higher than the first flow rate, and controls the bypass circuit (340) to allow flow through the bypass circuit such that a portion of the flow of pressurized hydraulic fluid provided at the second flow rate passes through the bypass circuit (340).

One general aspect of disclosed embodiments include a power machine (100; 200; 300) configured to have an implement coupled thereto, the implement having at least one implement actuator (330), and the power machine including: a frame (110; 210); a lift arm assembly (230) pivotally coupled to the frame; an implement carrier (272) pivotally coupled to the lift arm assembly and configured to have the implement coupled thereto; a lift actuator (238), coupled between the frame and the lift arm assembly and configured to raise and lower the lift arm assembly; a tilt actuator (235) pivotally coupled between the lift arm assembly and the implement carrier and configured to rotate the implement carrier relative to the lift arm assembly; an implement pump (224C; 310) configured to receive hydraulic fluid from a tank (302) through an input conduit (304) and to supply a flow of pressurized hydraulic fluid at an implement pump outlet conduit (312); a main control valve (320) coupled to the implement pump output conduit (312) and configured to provide pressurized hydraulic fluid from the implement pump to the lift actuator, to the tilt actuator, and at a control valve conduit (322) to the at least one implement actuator (330) of the implement coupled to the power machine; a bypass circuit (340) having an inlet conduit (314) coupled to the implement pump outlet conduit (312) to selectively receive a portion of the flow of pressurized hydraulic fluid from the implement pump and to provide the portion of the flow of pressurized hydraulic fluid to the at least one implement actuator (330) at a bypass circuit output conduit (342) coupled to the control valve conduit (322) such that flow of pressurize hydraulic fluid provided to the at least one implement actuator (330) is a combined flow including flow through the main control valve (320) and flow bypassing the main control valve by the bypass circuit (340); and a controller (350) coupled to the main control valve (320) and to the bypass circuit (340) to selectively control the main control valve and the bypass circuit to supply the combined flow of pressurized hydraulic fluid to the at least one implement actuator (330).

Implementations may include one or more of the following features. The power machine where the implement pump (224C; 310) is a variable displacement pump configured to provide a variable flow of pressurized hydraulic fluid at the implement pump outlet conduit (312) responsive to control signals from the controller (350).

The power machine where the controller (350) controls each of the implement pump (224C; 310), the main control valve (320) and the bypass circuit (340) responsive to signals from a user input (360) indicating a flow requirement to the at least one implement actuator (330).

The power machine where the controller (350) is configured such that responsive to signals from the user input indicating a standard flow requirement of the at least one implement actuator (330), the controller controls the variable displacement pump (224C; 310) to provide a first flow rate of pressurized hydraulic fluid at the implement pump outlet conduit (312) and controls the bypass circuit (340) to block flow through the bypass circuit such that substantially all of the flow of pressurized hydraulic fluid provided at the implement pump outlet conduit (312) passes through the main control valve (320).

The power machine where the controller (350) is configured such that responsive to signals from the user input indicating a higher flow requirement of the at least one implement actuator (330), the controller controls the variable displacement pump (224C; 310) to provide a second flow rate of pressurized hydraulic fluid, higher than the first flow rate, and controls the bypass circuit (340) to allow flow through the bypass circuit such that a portion of the flow of pressurized hydraulic fluid provided at the implement pump outlet conduit (312) passes through the bypass circuit (340).

This Summary and the Abstract are provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed embodiments of hydraulic systems allow power machine functions, such as lift, tilt and auxiliary (e.g., implement) function, to be provided with efficient hydraulic flow rates, while also allowing high-flow implements to be used. Disclosed embodiments incorporate a single variable displacement pump that supplies pressurized fluid to a main control valve (e.g., for lift, tilt and auxiliary functions) and a bypass circuit. The main control valve supplies fluid to control lift, tilt, and auxiliary flow for implements. The bypass circuit meets up with the output of the auxiliary section of the main control valve to optionally provide additional flow for selected implements. These selected implements are generally known as "high-flow implements." The single variable displacement pump can then be set to different output flow levels, with the bypass circuit functioning differently under different conditions to optimize hydraulic flow to carryout various tasks under various conditions.

Figure 2:
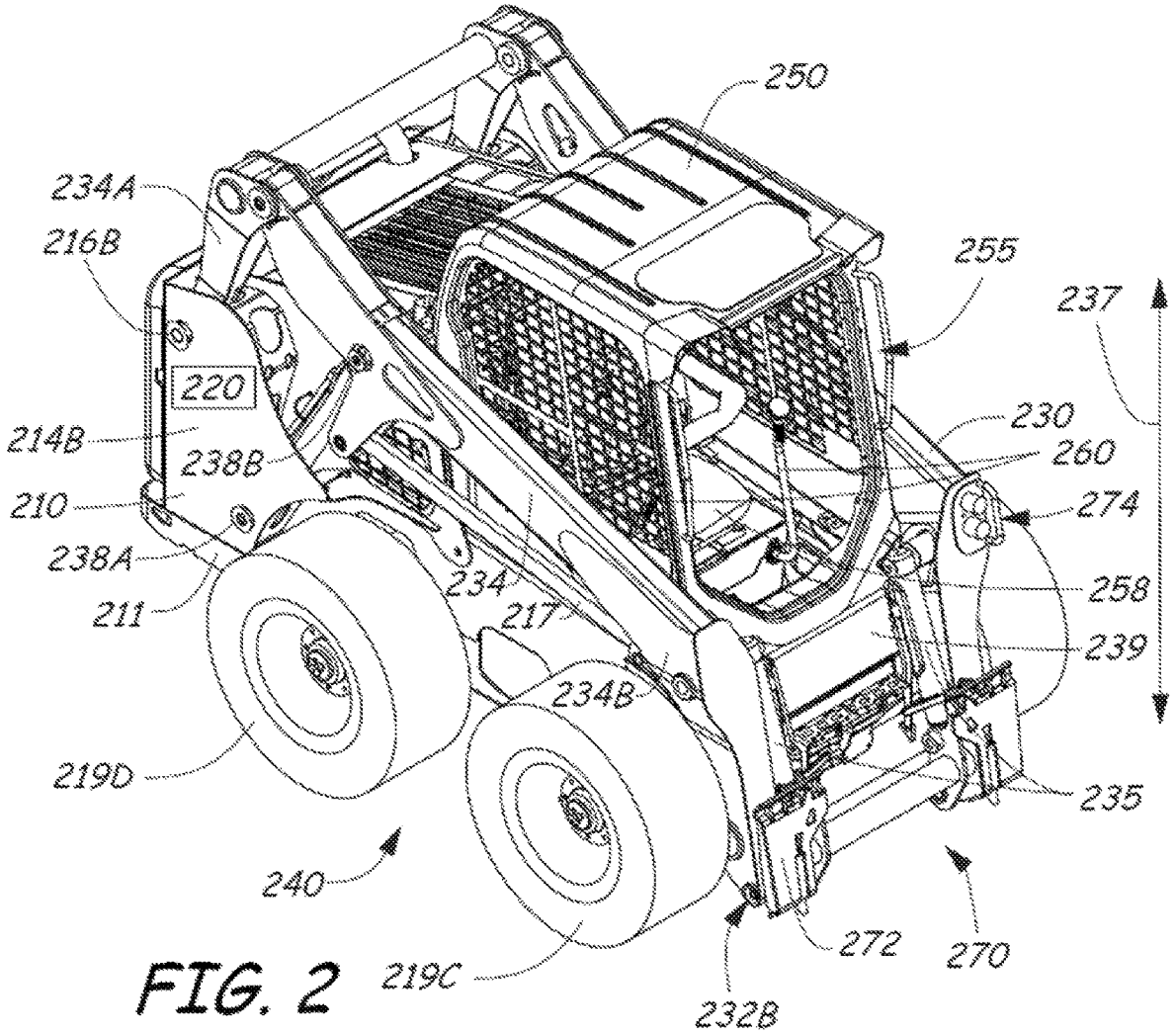
FIGS. 2-3 illustrate perspective views of a representative power machine in the form of a skid-steer loader of the type on which the disclosed embodiments can be practiced.
Figure 3:
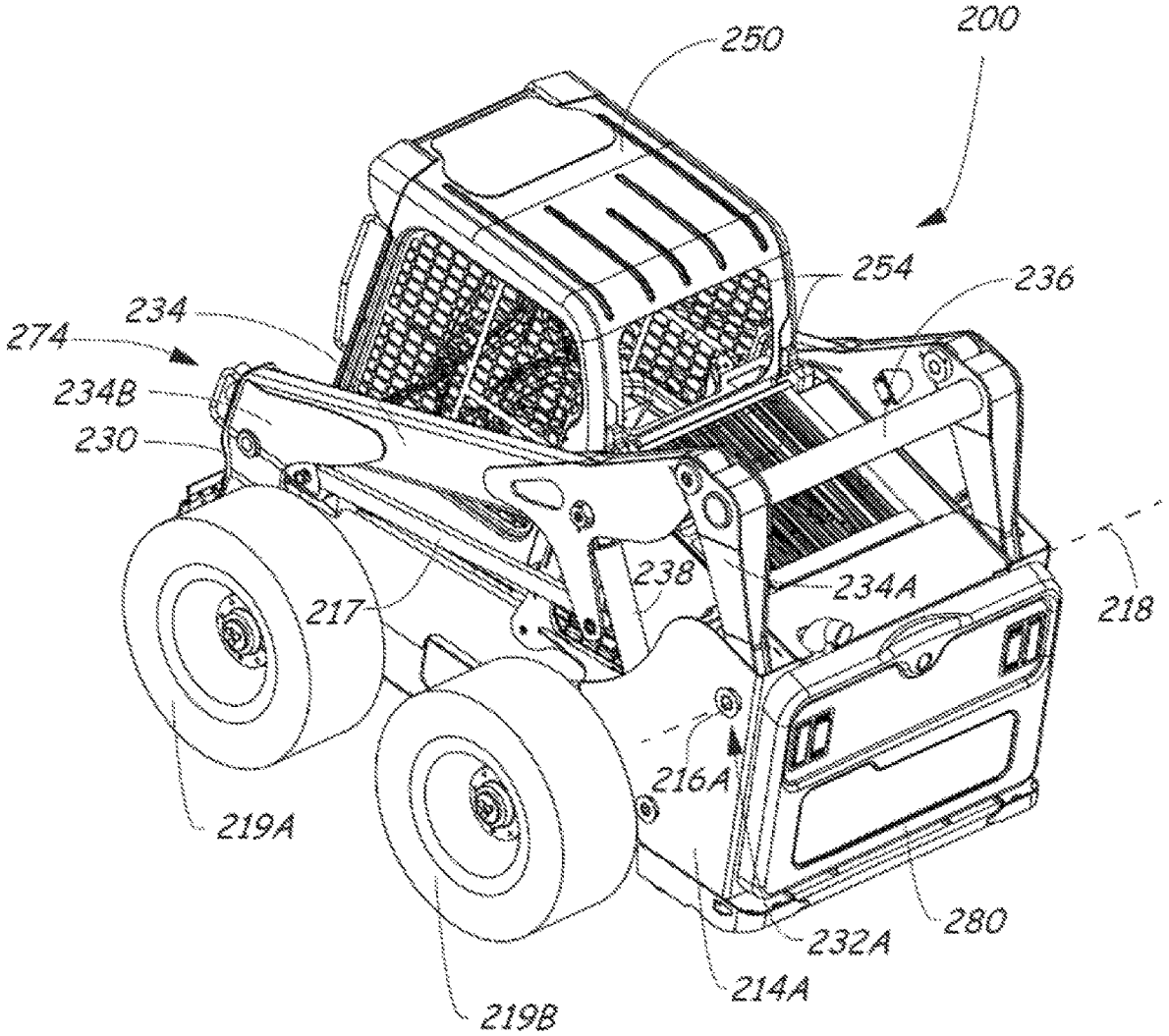

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is illustrated and discussed as being a representative power machine. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power.

Figure 1:
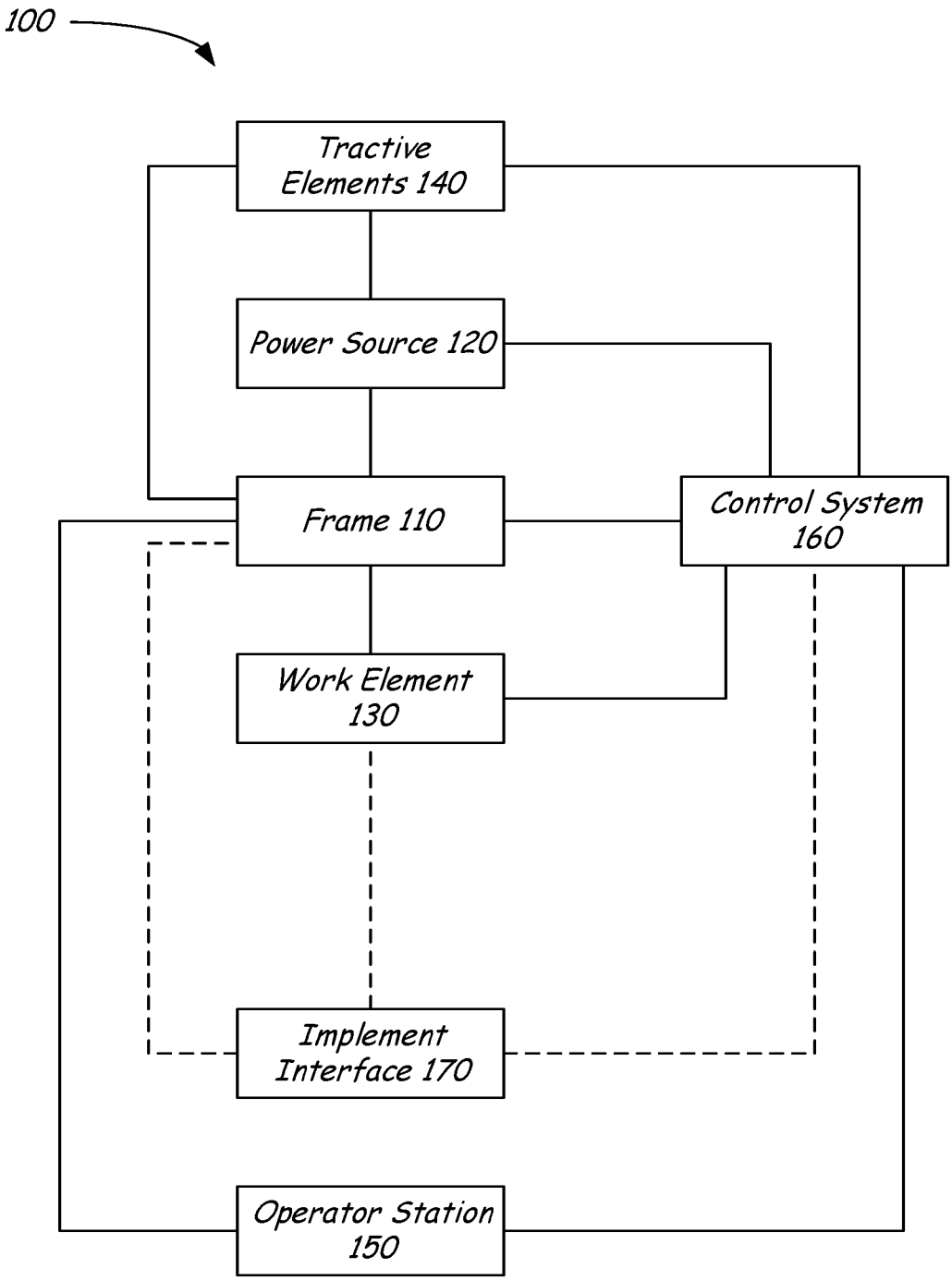
FIG. 1 is a block diagram illustrating functional systems of a representative power machine on which embodiments of the present disclosure can be advantageously practiced.

FIG. 1 is a block diagram that illustrates the basic systems of a power machine 100, which can be any of a number of different types of power machines, upon which the embodiments discussed below can be advantageously incorporated. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that are capable of performing a dedicated task. For example, some work vehicles have a lift arm to which an implement such as a bucket is attached such as by a pinning arrangement. The work element, i.e., the lift arm can be manipulated to position the implement for the purpose of performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that is capable of moving with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is configured to provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator controlled functions of the power machine can be operated from an operating position associated with an implement that is coupled to the power machine. Alternatively, with some power machines, a remote-control device can be provided (i.e. remote from both of the power machine and any implement to which is it coupled) that is capable of controlling at least some of the operator controlled functions on the power machine.

FIGS. 2-3 illustrate a loader 200, which is one particular example of a power machine of the type illustrated in FIG. 1 where the embodiments discussed below can be advantageously employed. Loader 200 is a skid-steer loader, which is a loader that has tractive elements (in this case, four wheels) that are mounted to the frame of the loader via rigid axles. Here the phrase "rigid axles" refers to the fact that the skid-steer loader 200 does not have any tractive elements that can be rotated or steered to help the loader accomplish a turn. Instead, a skid-steer loader has a drive system that independently powers one or more tractive elements on each side of the loader so that by providing differing tractive signals to each side, the machine will tend to skid over a support surface. These varying signals can even include powering tractive element(s) on one side of the loader to move the loader in a forward direction and powering tractive element(s) on another side of the loader to mode the loader in a reverse direction so that the loader will turn about a radius centered within the footprint of the loader itself. The term "skid-steer" has traditionally referred to loaders that have skid steering as described above with wheels as tractive elements. However, it should be noted that many track loaders also accomplish turns via skidding and are technically skid-steer loaders, even though they do not have wheels. For the purposes of this discussion, unless noted otherwise, the term skid-steer should not be seen as limiting the scope of the discussion to those loaders with wheels as tractive elements.

Loader 200 is one particular example of the power machine 100 illustrated broadly in FIG. 1 and discussed above. To that end, features of loader 200 described below include reference numbers that are generally similar to those used in FIG. 1. For example, loader 200 is described as having a frame 210, just as power machine 100 has a frame 110. Skid-steer loader 200 is described herein to provide a reference for understanding one environment on which the embodiments described below related to track assemblies and mounting elements for mounting the track assemblies to a power machine may be practiced. The loader 200 should not be considered limiting especially as to the description of features that loader 200 may have described herein that are not essential to the disclosed embodiments and thus may or may not be included in power machines other than loader 200 upon which the embodiments disclosed below may be advantageously practiced. Unless specifically noted otherwise, embodiments disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

Loader 200 includes frame 210 that supports a power system 220, the power system being capable of generating or otherwise providing power for operating various functions on the power machine. Power system 220 is shown in block diagram form, but is located within the frame 210. Frame 210 also supports a work element in the form of a lift arm assembly 230 that is powered by the power system 220 and can perform various work tasks. As loader 200 is a work vehicle, frame 210 also supports a traction system 240, which is also powered by power system 220 and can propel the power machine over a support surface. The lift arm assembly 230 in turn supports an implement interface 270, which includes an implement carrier 272 that can receive and securing various implements to the loader 200 for performing various work tasks and power couplers 274, to which an implement can be coupled for selectively providing power to an implement that might be connected to the loader. Power couplers 274 can provide sources of hydraulic or electric power or both. The loader 200 includes a cab 250 that defines an operator station 255 from which an operator can manipulate various control devices 260 to cause the power machine to perform various work functions. Cab 250 can be pivoted back about an axis that extends through mounts 254 to provide access to power system components as needed for maintenance and repair.

The operator station 255 includes an operator seat 258 and a plurality of operation input devices, including control levers 260 that an operator can manipulate to control various machine functions. Operator input devices can include buttons, switches, levers, sliders, pedals, and the like that can be stand-alone devices such as hand operated levers or foot pedals or incorporated into hand grips or display panels, including programmable input devices. Actuation of operator input devices can generate signals in the form of electrical signals, hydraulic signals, and/or mechanical signals. Signals generated in response to operator input devices are provided to various components on the power machine for controlling various functions on the power machine. Among the functions that are controlled via operator input devices on power machine 100 include control of the tractive elements 219, the lift arm assembly 230, the implement carrier 272, and providing signals to any implement that may be operably coupled to the implement.

Loaders can include human-machine interfaces including display devices that are provided in the cab 250 to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can be dedicated to providing dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such walk behind loaders may not have a cab nor an operator compartment, nor a seat. The operator position on such loaders is generally defined relative to a position where an operator is best suited to manipulate operator input devices.

Various power machines that can include and/or interacting with the embodiments discussed below can have various different frame components that support various work elements. The elements of frame 210 discussed herein are provided for illustrative purposes and frame 210 is not the only type of frame that a power machine on which the embodiments can be practiced can employ. Frame 210 of loader 200 includes an undercarriage or lower portion 211 of the frame and a mainframe or upper portion 212 of the frame that is supported by the undercarriage. The mainframe 212 of loader 200, in some embodiments is attached to the undercarriage 211 such as with fasteners or by welding the undercarriage to the mainframe. Alternatively, the mainframe and undercarriage can be integrally formed. Mainframe 212 includes a pair of upright portions 214A and 214B located on either side and toward the rear of the mainframe that support lift arm assembly 230 and to which the lift arm assembly 230 is pivotally attached. The lift arm assembly 230 is illustratively pinned to each of the upright portions 214A and 214B. The combination of mounting features on the upright portions 214A and 214B and the lift arm assembly 230 and mounting hardware (including pins used to pin the lift arm assembly to the mainframe 212) are collectively referred to as joints 216A and 216B (one is located on each of the upright portions 214) for the purposes of this discussion. Joints 216A and 216B are aligned along an axis 218 so that the lift arm assembly is capable of pivoting, as discussed below, with respect to the frame 210 about axis 218. Other power machines may not include upright portions on either side of the frame, or may not have a lift arm assembly that is mountable to upright portions on either side and toward the rear of the frame. For example, some power machines may have a single arm, mounted to a single side of the power machine or to a front or rear end of the power machine. Other machines can have a plurality of work elements, including a plurality of lift arms, each of which is mounted to the machine in its own configuration. Frame 210 also supports a pair of tractive elements in the form of wheels 219A-D on either side of the loader 200.

The lift arm assembly 230 shown in FIGS. 2-3 is one example of many different types of lift arm assemblies that can be attached to a power machine such as loader 200 or other power machines on which embodiments of the present discussion can be practiced. The lift arm assembly 230 is what is known as a vertical lift arm, meaning that the lift arm assembly 230 is moveable (i.e. the lift arm assembly can be raised and lowered) under control of the loader 200 with respect to the frame 210 along a lift path 237 that forms a generally vertical path. Other lift arm assemblies can have different geometries and can be coupled to the frame of a loader in various ways to provide lift paths that differ from the radial path of lift arm assembly 230. For example, some lift paths on other loaders provide a radial lift path. Other lift arm assemblies can have an extendable or telescoping portion. Other power machines can have a plurality of lift arm assemblies attached to their frames, with each lift arm assembly being independent of the other(s). Unless specifically stated otherwise, none of the inventive concepts set forth in this discussion are limited by the type or number of lift arm assemblies that are coupled to a particular power machine.

The lift arm assembly 230 has a pair of lift arms 234 that are disposed on opposing sides of the frame 210. A first end of each of the lift arms 234 is pivotally coupled to the power machine at joints 216 and a second end 232B of each of the lift arms is positioned forward of the frame 210 when in a lowered position as shown in FIG. 2. Joints 216 are located toward a rear of the loader 200 so that the lift arms extend along the sides of the frame 210. The lift path 237 is defined by the path of travel of the second end 232B of the lift arms 234 as the lift arm assembly 230 is moved between a minimum and maximum height.

Each of the lift arms 234 has a first portion 234A of each lift arm 234 is pivotally coupled to the frame 210 at one of the joints 216 and the second portion 234B extends from its connection to the first portion 234A to the second end 232B of the lift arm assembly 230. The lift arms 234 are each coupled to a cross member 236 that is attached to the first portions 234A. Cross member 236 provides increased structural stability to the lift arm assembly 230. A pair of actuators 238, which on loader 200 are hydraulic cylinders configured to receive pressurized fluid from power system 220, are pivotally coupled to both the frame 210 and the lift arms 234 at pivotable joints 238A and 238B, respectively, on either side of the loader 200. The actuators 238 are sometimes referred to individually and collectively as lift cylinders. Actuation (i.e., extension and retraction) of the actuators 238 cause the lift arm assembly 230 to pivot about joints 216 and thereby be raised and lowered along a fixed path illustrated by arrow 237. Each of a pair of control links 217 are pivotally mounted to the frame 210 and one of the lift arms 232 on either side of the frame 210. The control links 217 help to define the fixed lift path of the lift arm assembly 230.

Some lift arms, most notably lift arms on excavators but also possible on loaders, may have portions that are controllable to pivot with respect to another segment instead of moving in concert (i.e. along a pre-determined path) as is the case in the lift arm assembly 230 shown in FIG. 2. Some power machines have lift arm assemblies with a single lift arm, such as is known in excavators or even some loaders and other power machines. Other power machines can have a plurality of lift arm assemblies, each being independent of the other(s).

An implement interface 270 is provided proximal to a second end 232B of the lift arm assembly 234. The implement interface 270 includes an implement carrier 272 that can accept and securing a variety of different implements to the lift arm 230. Such implements have a complementary machine interface that is configured to be engaged with the implement carrier 272. The implement carrier 272 is pivotally mounted at the second end 232B of the arm 234. Implement carrier actuators 235 are operably coupled the lift arm assembly 230 and the implement carrier 272 and are operable to rotate the implement carrier with respect to the lift arm assembly. Implement carrier actuators 235 are illustratively hydraulic cylinders and often known as tilt cylinders.

By having an implement carrier capable of being attached to a plurality of different implements, changing from one implement to another can be accomplished with relative ease. For example, machines with implement carriers can provide an actuator between the implement carrier and the lift arm assembly, so that removing or attaching an implement does not involve removing or attaching an actuator from the implement or removing or attaching the implement from the lift arm assembly. The implement carrier 272 provides a mounting structure for easily attaching an implement to the lift arm (or other portion of a power machine) that a lift arm assembly without an implement carrier does not have.

Some power machines can have implements or implement like devices attached to it such as by being pinned to a lift arm with a tilt actuator also coupled directly to the implement or implement type structure. A common example of such an implement that is rotatably pinned to a lift arm is a bucket, with one or more tilt cylinders being attached to a bracket that is fixed directly onto the bucket such as by welding or with fasteners. Such a power machine does not have an implement carrier, but rather has a direct connection between a lift arm and an implement.

The implement interface 270 also includes an implement power source 274 available for connection to an implement on the lift arm assembly 230. The implement power source 274 includes pressurized hydraulic fluid port to which an implement can be removably coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The implement power source 274 also exemplarily includes electrical conduits that are in communication with a data bus on the excavator 200 to allow communication between a controller on an implement and electronic devices on the loader 200.

Figure 4:
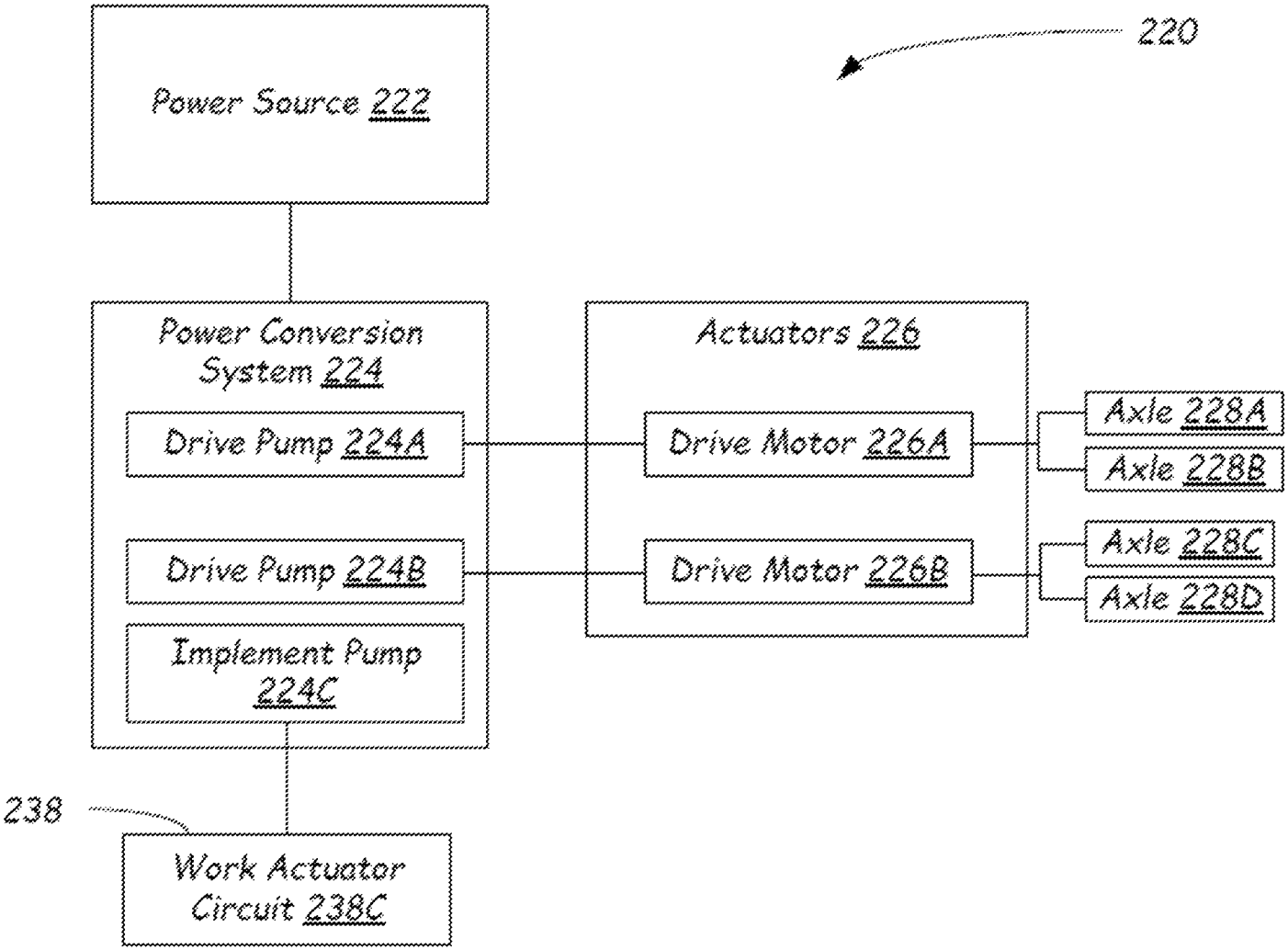
FIG. 4 is a block diagram illustrating components of a power system of a loader such as the loader illustrated in FIGS. 2-3.

Frame 210 supports and generally encloses the power system 220 so that the various components of the power system 220 are not visible in FIGS. 2-3. FIG. 4 includes, among other things, a diagram of various components of the power system 220. Power system 220 includes one or more power sources 222 that can generate and/or storing power for use on various machine functions. On power machine 200, the power system 220 includes an internal combustion engine. Other power machines can include electric generators, rechargeable batteries, various other power sources or any combination of power sources that can provide power for given power machine components. The power system 220 also includes a power conversion system 224, which is operably coupled to the power source 222. Power conversion system 224 is, in turn, coupled to one or more actuators 226, which can perform a function on the power machine. Power conversion systems in various power machines can include various components, including mechanical transmissions, hydraulic systems, and the like. The power conversion system 224 of power machine 200 includes a pair of hydrostatic drive pumps 224A and 224B, which are selectively controllable to provide a power signal to drive motors 226A and 226B. The drive motors 226A and 226B in turn are each operably coupled to axles, with drive motor 226A being coupled to axles 228A and 228B and drive motor 226B being coupled to axles 228C and 228D. The axles 228A-D are in turn coupled to tractive elements 219A-D, respectively. The drive pumps 224A and 224B can be mechanically, hydraulic, and/or electrically coupled to operator input devices to receive actuation signals for controlling the drive pumps.

The arrangement of drive pumps, motors, and axles in power machine 200 is but one example of an arrangement of these components. As discussed above, power machine 200 is a skid-steer loader and thus tractive elements on each side of the power machine are controlled together via the output of a single hydraulic pump, either through a single drive motor as in power machine 200 or with individual drive motors. Various other configurations and combinations of hydraulic drive pumps and motors can be employed as may be advantageous.

The power conversion system 224 of power machine 200 also includes a hydraulic implement pump 224C, which is also operably coupled to the power source 222. The hydraulic implement pump 224C is operably coupled to work actuator circuit 238C. Work actuator circuit 238 includes lift cylinders 238 and tilt cylinders 235 as well as control logic (such as one or more valves) to control actuation thereof. The control logic selectively allows, in response to operator inputs, for actuation of the lift cylinders and/or tilt cylinders. In some machines, the work actuator circuit also includes control logic to selectively provide a pressurized hydraulic fluid to an attached implement.

The description of power machine 100 and loader 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on a loader such as track loader 200, unless otherwise noted or recited, the concepts discussed below are not intended to be limited in their application to the environments specifically described above.

Figure 5:
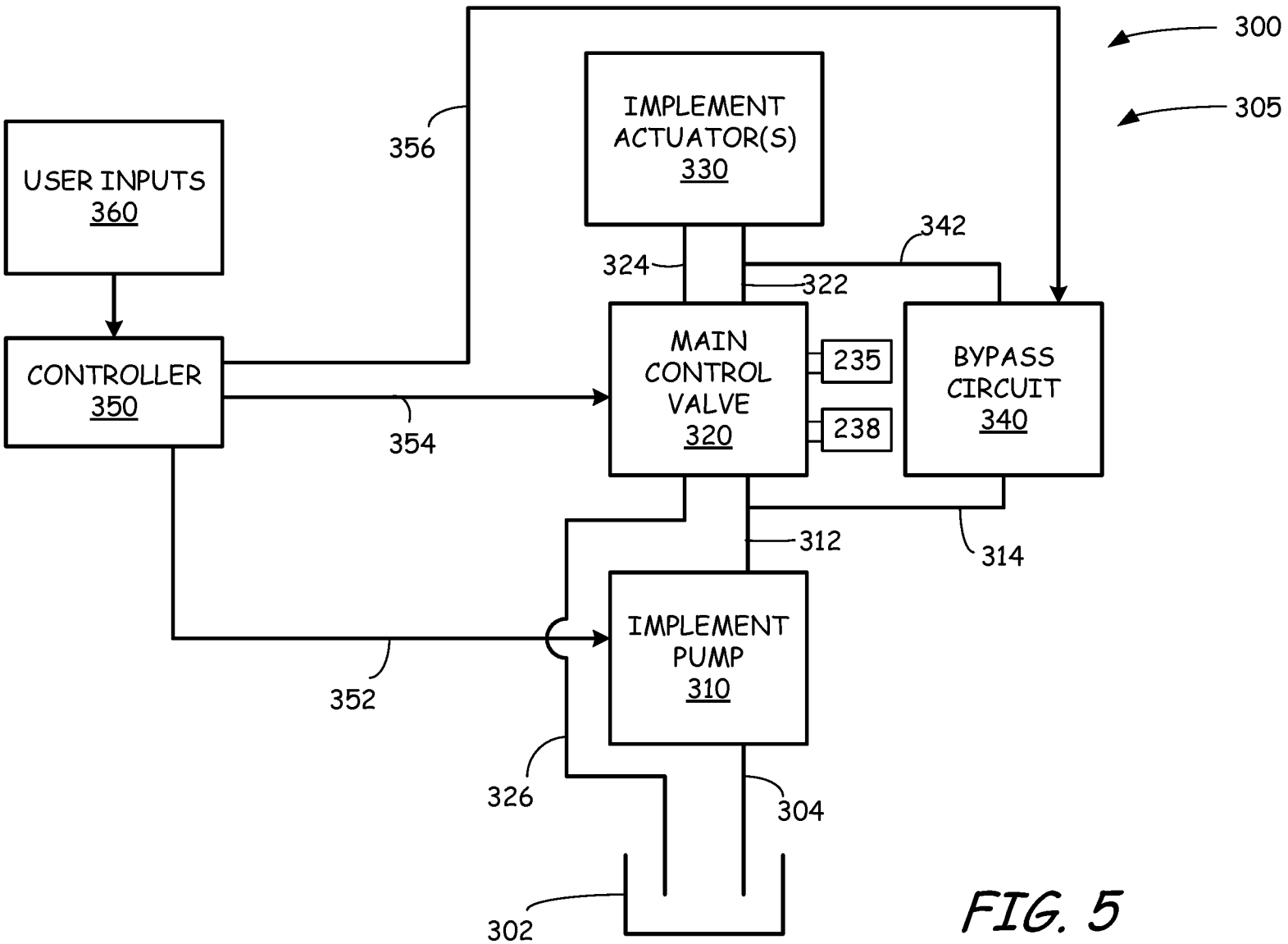
FIG. 5 is a block diagram illustrating components of a power system, of a loader such as the loader illustrated in FIGS. 2-3 and which can be an embodiment of or include features from the power system shown in FIG. 4, including a hydraulic bypass circuit configured to provide additional flow to an attached "high-flow" implement.

FIG. 5 is a block diagram that illustrates some components of a power system 305 of a power machine 300, which can be a power machine such as power machines 100 and 200 discussed above, including components of a hydraulic system in accordance with disclosed embodiments. FIG. 5 can be an embodiment of a power system as shown in FIG. 4 discussed above. FIG. 5 illustrates an implement pump 310, similar to implement pump 224C discussed above, that receives hydraulic fluid from tank 302 or elsewhere through an input conduit 304. Implement pump 310 is a variable displacement pump that supplies pressurized fluid flow from outlet conduit 312 to a main control valve 320 and to a bypass circuit 340. Inlet conduit 314 of bypass circuit 340 is coupled to outlet conduit 312 of the implement pump 310 to selectively receive a portion of the pump flow under certain circumstances. Main control valve 320 supplies pressurized hydraulic fluid to control lift and tilt actuators 238 and 235 on a lift arm structure, and to control auxiliary functions on an attached implement. For illustrative purposes, the lift and tilt actuators are not shown in detail in FIG. 5. Flow from main control valve 320 to implement actuator(s) 330, representing auxiliary functions on an implement attached to the lift arm structure using an implement carrier, is provided through control valve output conduit 322.

Bypass circuit 340 selectively receives a portion of the flow from implement pump 310 via conduit 314, with the output flow from bypass circuit 340 provided at output conduit 342 being combined with the output conduit 322 of main control valve 320. The combined flow is then provided to implement actuator(s) 330. Thus, the bypass circuit flow meets up with the output of the auxiliary section of the main control valve 320 to provide additional flow for selected high-flow implements that require higher flow rates. The combined flow from main control valve 320 and bypass circuit 340 for high-flow implements ensures that the additional flow provided by implement pump 310 is provided for use with the auxiliary functions of the implement actuators. Return flow from the implement actuator 330 is provided through conduit 324 to main control valve 320, and through conduit 326 to tank 302, for example.

Electronic controller 350 is in electrical communication with implement pump 310 through signal line 352, to main control valve 320 through signal line(s) 354, and to bypass circuit 340 through signal line(s) 356. In other embodiments, communication between the controller 350 and one or more of the actuators in the control valve 320, bypass circuit 340, and the implement 310 can be wireless. Each of implement pump 310, main control valve 320 and bypass circuit 340 is controllable by controller 350 responsive to signals from user inputs 360. Thus, when user inputs 360 indicate an increased flow requirement to implement actuator(s) 330, the output flow level of implement pump 310 can be increased. At the same time, controller 350 can control bypass circuit 340 to allow a portion of the output flow from implement pump 310 to pass through the bypass circuit and be provided as a combined flow with the auxiliary output flow of main control valve 320 at output conduit 322.

With implement pump 310 being controllable to provide different output flow levels, controller 350 is configured to control bypass circuit 340 to function based upon the output flow levels of the implement pump. For example, at a standard flow rate provided by implement pump 310, controller 350 can control bypass circuit 340 to block flow so that all the output flow from the pump goes through main control valve 320. However, at higher flow rates, a flow control valve 416 (shown in FIG. 6) in the bypass circuit 340 can be opened by controller 350 to draw a portion of the pump output flow through the bypass circuit. A pressure compensating valve 414 (also shown in FIG. 6) can be provided in the bypass circuit to limit flow through the bypass circuit during high pressure conditions at the outlet of the pump. This ensures that adequate flow is provided to the main control valve to make certain that the lift and tilt functions (lift and tilt actuators not shown in FIGS. 5 and 6) are properly supplied. Thus, the power system 305 shown in FIG. 5 allows for multiple flow output rates from implement pump 310, which can be tailored to control various types of implements. By including a bypass circuit, flow is limited through the main control valve, which can improve efficiency since the main control valve is typically more complex (i.e. complex passageways and is more compact) and causes a higher pressure drop, if all of the flow that is provided through the bypass would be provided through main control valve instead. In addition, passing additional flow through the main control valve would impact the operation of lift and tilt cylinders.

Figure 6:
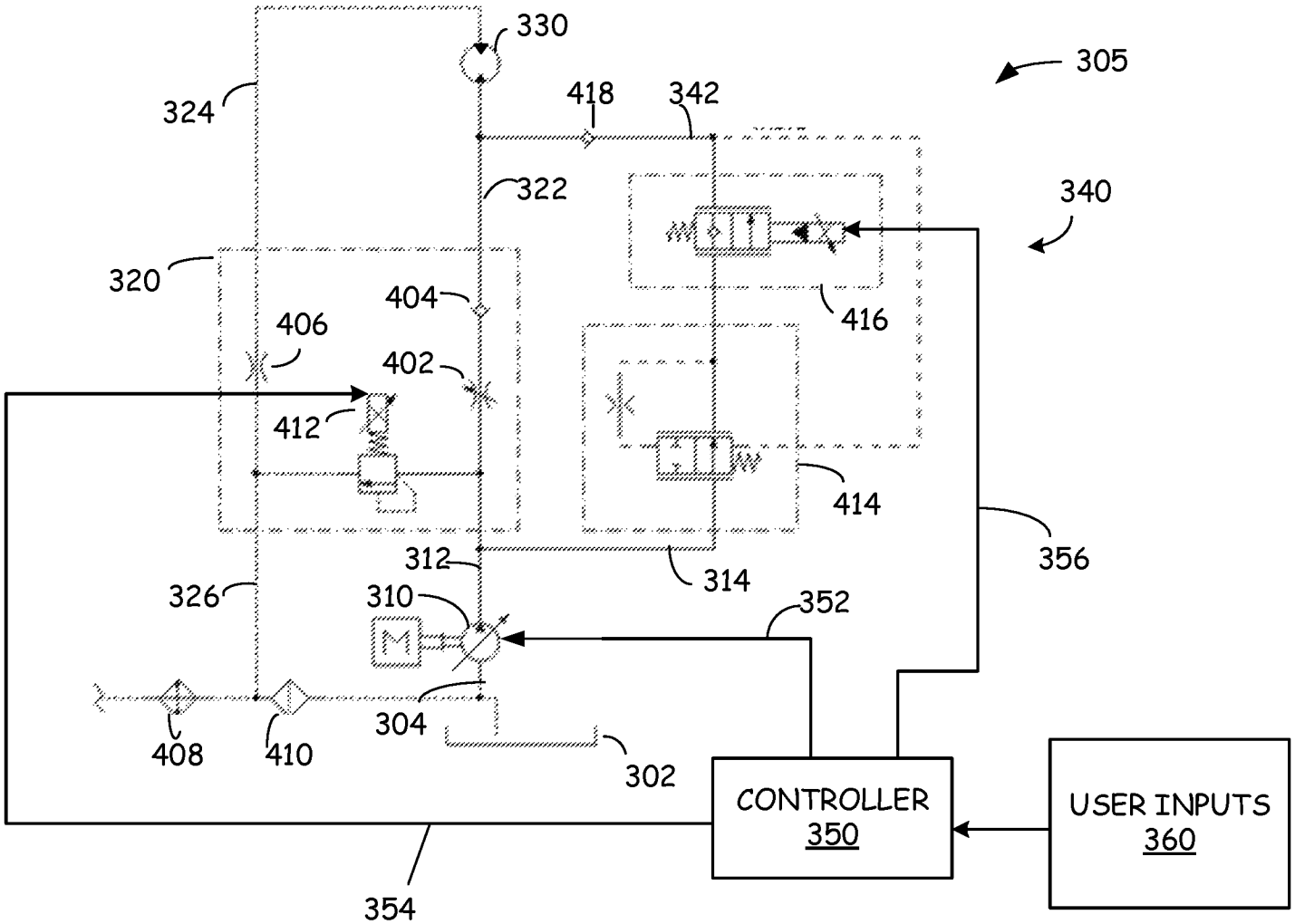
FIG. 6 is a hydraulic circuit diagram illustrating an example of the hydraulic bypass circuit shown in FIG. 5.

Referring now to FIG. 6, an example circuit is provided to illustrate a more particular embodiment of the bypass circuit 340 of power system 305. Variable displacement pump 310 provides flow, under the control of signal 352 from controller 350, to conduit 312 and main control valve 320. Main control valve 320 includes a flow restrictor 402 and check valve 404 in the flow path to output conduit 322 provided as an input to implement actuator 330. Main control valve 320 also typically includes further components and features for providing flow paths for providing flow of hydraulic fluid or oil to lift and tilt actuators, but these components and features of control valve 320 are omitted to simplify the illustration of exemplary features of disclosed embodiments. Implement actuator 330 is illustrated as a motor but need not be in all embodiments. Further, implement actuator 330 can be multiple actuators or motors on an implement. The return flow from implement actuator 330 provided through conduit 324 passes through flow restrictor 406 in main control valve 320 before being provided through conduit 326 and returned to tank 302. Optionally, an oil cooler 408 and a filter 410 can be included to cool and clean the hydraulic fluid.

Within main control valve 320, a variable auxiliary relief valve 412 can be coupled between the supply and return lines to provide an over-pressure relief path. The variable auxiliary relief valve 412 can be controlled by controller 350 to set a maximum pressure for use with particular implements. As some implements may be able to handle higher pressures than others, allowing controller 350 to set the auxiliary relief pressure setting of valve 412 provides greater flexibility to utilize a large number of different implements.

As shown in FIG. 6, bypass circuit 340 includes, in an exemplary embodiment, a pressure compensator valve 414 and a flow control valve 416. Flow control valve 416 is controlled by signal 356 from controller 340 in order to allow or block flow through the bypass circuit 340 for different pump output flow levels or for different operating modes. The output conduit 342 of bypass circuit 340 is coupled to the output of flow control valve 416 and, through check valve 418, to conduit 322 from main control valve 320. Pressure compensating valve 414 is provided to limit flow through bypass circuit 340 during high pressure conditions at the outlet of pump 310. Again, this ensures that adequate flow is provided to main control valve 320 so that lift and tilt functions (not shown in FIG. 6) can be properly supplied.

As bypass circuit 340 allows for multiple flow output rates from pump 310 to be provided to control various types of implements, power system 300 provides advantages over conventional power systems. By using bypass circuit 340, flow is limited through main control valve 320, which can improve efficiency because the main control valve 320 typically incurs a higher pressure drop. Further, use of bypass circuit 340 allows implement pump 310 to be a variable displacement pump, and thereby improves efficiency by providing high flow rates only when required for a high-flow implement.

In one example, power system 300 can utilize multiple flow levels from pump 310. For example, a first level of approximately 23 gallons per minute (GPM) can be used. A second level of approximately 37 GPM can also be provided as a traditional high flow rate. A third flow rate level can also be provided to accommodate various implements or modes of operation. For example, the third flow rate can be above or below the second flow rate, and in one example the third flow rate is approximately 45 GPM. However, while these flow rate levels are provided as an example, the disclosed embodiments are not limited to any particular number of flow rate levels or specific flow rates within each level.

Although the present invention has been described with reference to preferred embodiments, workers skilled in the art will recognize that changes may be made in form and detail without departing from the scope of the discussion.

What is claimed is:

1. A circuit of a power machine for providing power to at least one implement actuator of an implement mounted on the power machine, the hydraulic circuit comprising:

a variable displacement implement pump configured to receive hydraulic fluid from a tank through an input conduit and to supply a variable flow of pressurized hydraulic fluid at an implement pump outlet conduit;

a main control valve coupled to the implement pump output conduit and having separate main control valve outputs coupled respectively to a lift actuator, a tilt actuator, and through a First control valve output conduit to at least one implement actuator, the main control valve configured to provide, from the separate main control valve outputs, pressurized hydraulic fluid from the variable displacement implement pump to the lift actuator, to the tilt actuator, and through the first control valve output conduit, to the at least one implement actuator; and a bypass circuit having an inlet conduit coupled to the implement pump outlet conduit to selectively receive a portion of the variable flow of pressurized hydraulic fluid from the implement pump and to provide the portion of the flow of pressurized hydraulic fluid to the at least one implement actuator at a bypass circuit output conduit coupled to the first control valve output conduit such that flow of pressurized hydraulic fluid provided to the at least one implement actuator is a combined flow including flow through the main control valve and the portion of the variable flow bypassing the main control valve, and such that the portion of the variable flow bypassing the main control valve bypasses the main control valve outputs coupled to the lift actuator and the tilt actuator so that the variable flow bypassing the main control valve is not available for the lift actuator and the tilt actuator.

2. The circuit of claim 1 and further comprising a controller in communication with both the main control valve and the bypass circuit to selectively control the main control valve and the bypass circuit to supply the combined flow of pressurized hydraulic fluid to the at least one implement actuator.

3. The circuit of claim 2, wherein the variable displacement implement pump is configured to provide the variable flow of pressurized hydraulic fluid at the implement pump outlet conduit responsive to control signals from the controller.

4. The circuit of claim 3, wherein the controller controls each of the implement pump, the main control valve and the bypass circuit responsive to signals from a user input indicating an increased flow requirement to the at least one implement actuator.

5. The circuit of claim 4, wherein the controller is configured such that responsive to signals from the user input indicating a standard flow requirement of the at least one implement actuator, the controller controls the variable displacement pump to provide a first flow rate of pressurized hydraulic fluid at the implement pump outlet conduit and controls the bypass circuit to block flow through the bypass circuit such that substantially all of the flow of pressurized hydraulic fluid provided at the first flow rate passes through the main control valve and is also available, under selective control of the main control valve, for the lift actuator and the tilt actuator.

6. The circuit of claim 4, wherein the controller is configured such that responsive to signals from the user input indicating a higher flow requirement, relative to the standard flow requirement, of the at least one implement actuator, the controller controls the variable displacement pump to provide a second flow rate of pressurized hydraulic fluid, higher than the first flow rate, and controls the bypass circuit to allow flow through the bypass circuit such that a portion of the flow of pressurized hydraulic fluid provided at the second flow rate passes through the bypass circuit and is thereby not available for the lift actuator and the tilt actuator.

7. The circuit of claim 1, wherein the main control valve includes a flow restrictor and a check valve in a fluid path to the control valve output conduit, with the check valve positioned between the flow restrictor and the control valve output conduit.

8. The circuit of claim 1, wherein the bypass circuit further comprises a flow control valve, controlled by control signals from the controller, and configured to allow or block flow of pressurized hydraulic fluid through the bypass circuit.

9. The circuit of claim 8, wherein the bypass circuit further comprises a pressure compensator valve configured to limit flow of pressurized hydraulic fluid through bypass circuit, when the flow control valve allows flow of pressurized fluid through the bypass circuit, during high pressure conditions at the implement pump outlet conduit to ensure flow of pressurized fluid through the main control valve for use by the lift actuator and the tilt actuator.

10. A power machine configured to have an implement coupled thereto, the implement having at least one implement actuator, the power machine comprising:

a frame;

a lift arm assembly pivotally coupled to the frame;

an implement carrier pivotally coupled to the lift arm assembly and configured to have the implement coupled thereto;

a lift actuator, coupled between the frame and the lift arm assembly and configured to raise and lower the lift arm assembly;

a tilt actuator pivotally coupled between the lift arm assembly and the implement carrier and configured to rotate the implement carrier relative to the lift arm assembly;

an implement pump configured to receive hydraulic fluid from a tank through an input conduit and to supply a flow of pressurized hydraulic fluid at an implement pump outlet conduit;

a main control valve coupled to the implement pump output conduit and having separate main control valve outputs coupled respectively to the lift actuator, the tilt actuator, and through a first control valve output conduit to the at least one implement actuator, the main control valve configured to provide, from the separate main control valve outputs, pressurized hydraulic fluid from the implement pump to the lift actuator, to the tilt actuator, and through the first control valve output conduit, to the at least one implement actuator of the implement coupled to the power machine;

a bypass circuit having an inlet conduit coupled to the implement pump outlet conduit to selectively receive a portion of the flow of pressurized hydraulic fluid from the implement pump and to provide the portion of the flow of pressurized hydraulic fluid to the at least one implement actuator at a bypass circuit output conduit coupled to the first control valve output conduit such that flow of pressurized hydraulic fluid provided to the at least one implement actuator is a combined flow including flow through the main control valve, which was available for use with the lift actuator and the tilt actuator through the separate main control valve outputs, and flow bypassing the main control valve by the bypass circuit, and such that the flow bypassing the main control valve bypasses the main control valve outputs coupled to the lift actuator and the tilt actuator, wherein the bypass circuit further comprises a flow control valve configured to selectively allow or block the portion of the flow of pressurized hydraulic fluid through the bypass circuit, the bypass circuit further comprising a pressure compensator valve configured to limit the portion of the flow of pressurized hydraulic fluid through the bypass circuit, when the flow control valve allows the portion of the flow of pressurized hydraulic fluid through the bypass circuit, during high pressure conditions at the implement pump outlet conduit to ensure flow of pressurized fluid through the main control valve for use by the lift actuator and the tilt actuator; and a controller coupled to the main control valve and to the bypass circuit to selectively control the main control valve and the bypass circuit to supply the combined flow of pressurized hydraulic fluid to the at least one implement actuator.

11. The power machine of claim 10, wherein the implement pump is a variable displacement pump configured to provide a variable flow of pressurized hydraulic fluid at the implement pump outlet conduit responsive to control signals from the controller.

12. The power machine of claim 11, wherein the controller controls each of the implement pump, the main control valve and the bypass circuit responsive to signals from a user input indicating a flow requirement to the at least one implement actuator.

13. The power machine of claim 12, wherein the controller is configured such that responsive to signals from the user input indicating a standard flow requirement of the at least one implement actuator, the controller controls the variable displacement pump to provide a first flow rate of pressurized hydraulic fluid at the implement pump outlet conduit and controls the bypass circuit to block flow through the bypass circuit such that substantially all of the flow of pressurized hydraulic fluid provided at the implement pump outlet conduit passes through the main control valve.

14. The power machine of claim 13, wherein the controller is configured such that responsive to signals from the user input indicating a higher flow requirement, relative to the standard flow requirement, of the at least one implement actuator, the controller controls the variable displacement pump to provide a second flow rate of pressurized hydraulic fluid, higher than the first flow rate, and controls the bypass circuit to allow flow through the bypass circuit such that a portion of the flow of pressurized hydraulic fluid provided at the implement pump outlet conduit passes through the bypass circuit.

* * * * *